US006585829B1

(12) United States Patent
Suzuki et al.

(10) Patent No.: US 6,585,829 B1
(45) Date of Patent: Jul. 1, 2003

(54) METHOD FOR WASHING CONTAINER

(75) Inventors: Noboru Suzuki, Hiratsuka (JP); Yuuki Yoneyama, Hiratsuka (JP)

(73) Assignee: Japan Crown Cork Co., Ltd., Tokyo (JP)

( * ) Notice: Subject to any disclaimer, the term of this patent is extended or adjusted under 35 U.S.C. 154(b) by 0 days.

(21) Appl. No.: 09/481,555

(22) Filed: Jan. 11, 2000

(51) Int. Cl.[7] ..... B08B 3/02; B08B 3/10; B08B 9/08; B08B 9/093; B08B 9/28

(52) U.S. Cl. ..... 134/19; 134/23; 134/25.1; 134/25.5; 134/26; 134/32; 134/42; 134/63; 134/105; 134/172; 134/170

(58) Field of Search ..... 134/19, 23, 25.1, 134/25.3, 25.5, 26, 32

(56) References Cited

U.S. PATENT DOCUMENTS

| | | | | |
|---|---|---|---|---|
| 3,918,605 A | * | 11/1975 | Butler | 220/65 R |
| 4,102,350 A | * | 7/1978 | Chelton et al. | 134/130 |
| 5,316,030 A | * | 5/1994 | Shimizu et al. | 134/105 |

FOREIGN PATENT DOCUMENTS

| | | | |
|---|---|---|---|
| JP | 05065151 | | 3/1993 |
| JP | 10001158 | | 1/1998 |
| JP | 10152156 | | 6/1998 |
| JP | 11-208693 | * | 8/1999 |

OTHER PUBLICATIONS

Encyclopedia of beverages including fruit juice or fruit, which was published in 1997, pp. 106–111, pp. 393–415, in Japanese, English translation of excerpts from pp. 106 and 109.

* cited by examiner

*Primary Examiner*—Zeinab El-Arini
(74) *Attorney, Agent, or Firm*—Antonelli, Terry, Stout & Kraus, LLP

(57) ABSTRACT

A method of washing a container,including charging a material to be contained into a container body having a mouth-and-neck portion; mounting a container closure on the mouth-and-neck portion of the container body, the container closure having a top panel wall, a cylindrical skirt wall extending downwardly from a peripheral edge of the top panel wall, and a washing liquid passage formed in at least one of an upper portion of the skirt wall and a peripheral edge portion of the top panel wall; and jetting a washing liquid at the container closure so that the washing liquid passes through the washing liquid passage and enters a space between the mouth-and-neck portion of the container body and the skirt wall of the container closure, thereby washing an outer peripheral surface of the mouth-and-neck portion of the container body and an inner peripheral surface of the skirt wall of the container closure. The washing liquid is at a temperature of 65° C. to 70° C. when the washing liquid is jetted at the container closure. Alternatively, the container closure is heated to 70° C. or higher, and then the washing liquid of 45 to 70° C. is jetted at the container closure.

21 Claims, 3 Drawing Sheets

METHOD FOR WASHING CONTAINER

FIELD OF THE INVENTION

This invention relates to a method for washing a container, the method comprising charging a material to be contained into a container body; then mounting a container closure on a mouth-and-neck portion of the container body, the container closure having a top panel wall and cylindrical skirt wall extending downwardly from a peripheral edge of the top panel wall; and then jetting washing liquid at the container closure so that the washing liquid passes through a washing liquid passage formed in the container closure, and enters a space between an outer peripheral surface of the mouth-and-neck portion of the container body and an inner peripheral surface of the skirt wall of the container closure.

DESCRIPTION OF THE PRIOR ART

As is well known among people skilled in the art, when a material to be contained, such as a beverage, is charged into a container body, some of the material tends to scatter and adhere to the outer peripheral surface of the mouth-and-neck portion of the container body. If the material that has scattered and adhered to the outer peripheral surface of the mouth-and-neck portion is allowed to remain untreated, this material will decay and pose a hygienic problem. Alternatively, the material solidifies in a space between the outer peripheral surface of the mouth-and-neck portion of the container body and an inner peripheral surface of a skirt wall of the container closure, thereby excessively increasing the unsealing torque required when unsealing the container (the torque necessary for turning the container closure). Thus, a proposal has been made to form a washing liquid passage, which may be perforating slits or holes, in an upper portion of the skirt wall of the container closure and/or the peripheral edge portion of the top panel wall of the container closure; mount the container closure on the mouth-and-neck portion of the container body to seal the mouth-and-neck portion; and then jet a washing liquid, which may be tap water, toward the container closure so that the washing liquid passes through the washing liquid passage and enters the space between the outer peripheral surface of the mouth-and-neck portion of the container body and the inner peripheral surface of the skirt wall of the container closure, thereby washing off the material that has been scattered and adhered to the outer peripheral surface of the mouth-and-neck portion, and the material that has migrated from the outer peripheral surface of the mouth-and-neck portion to the inner peripheral surface of the skirt wall of the container closure.

Generally, the container body is formed of a suitable plastic material, such as polyethylene terephthalate, or glass. Recently, as the container closure, on the other hand, a plastic container closure formed of a suitable plastic material, such as polypropylene or polyethylene, has been in wide use in place of a container closure of a thin metal plate. In the case of a plastic container closure, when the container closure is compression or injection molded, it can be formed with a plurality of perforating slits or holes in the skirt wall and/or the top panel wall so that the slits or holes will function as washing liquid passages. However, the slits or holes formed during compression or injection molding are necessarily relatively large in size because of demolding, etc. Thus, dirt is highly likely to build up in the slits or holes, or to reach the outer peripheral surface of the mouth-and-neck portion of the container through the slits or holes.

Moreover, the slits or holes may be clearly detected visually to impair the appearance of the container closure.

In light of the foregoing problems with the conventional plastic container closure, Japanese Laid-Open Patent Publication No. 208693/1999 proposes that after a container closure is compression or injection molded, a cutting blade is applied to the outer surface of the container closure to cut and perforate the container closure so that the resulting plural cuts will function as washing liquid passage means. Such cuts can be formed in so small a size that it is difficult to detect them visually. Hence, the above-described problems with the conventional plastic container closure can be solved.

The cuts formed by applying the cutting blade onto the outer surface of the container closure to cut and perforate the container closure should be as small as possible in size in connection with the aforementioned problems about dirt and appearance. However, the formation of the cuts in a sufficiently small size in regard to the problems about dirt and appearance may pose another problem: Even when a washing liquid is jetted toward the container closure for washing after mounting of the container closure on the mouth-and-neck portion of the container body, the washing liquid may fail to pass sufficiently through the washing liquid passages composed of the cuts. Hence, the washing tends to fail.

SUMMARY OF THE INVENTION

The object of the present invention is to provide a novel and excellent method for washing a container, by which a washing liquid fully passes through a washing liquid passage composed of cuts to achieve through washing, even when the cuts are formed in a sufficiently small size in order to solve the problems about dirt and appearance.

The inventors of the present invention conducted extensive studies and experiments. As a result, they found, to their surprise, that by the following measure (1) or (2)

(1) heating the washing liquid to 65° C. or higher and jetting it, or (2) heating the container closure to 70° C. or higher, and then jetting the washing liquid heated to 45 to 70° C., the washing liquid can be passed through cuts constituting washing liquid passages, and admitted into the space between the outer peripheral surface of the mouth-and-neck portion of a container and the inner peripheral surface of the skirt wall of the container closure to achieve the desired washing. To assist in producing washing action, the temperature of the washing liquid and/or the temperature of heating of the container closure is desirably as high as possible. However, if the material contained in the container is excessively heated, its taste may deteriorate. With care being taken for this fact, the temperature of the washing liquid and/or the heating temperature of the container closure should be set.

Because of the above measure (1) heating the washing liquid to 65° C. or higher and jetting it, or (2) heating the container closure to 70° C. or higher, and then jetting a washing liquid heated to 45 to 70° C., the washing liquid passes satisfactorily through the washing liquid passage, even when cuts constituting the washing liquid passage are sufficiently small in size. The reason for this advantage is not entirely clear, but the inventors speculate as follows: Since the temperature of the container closure is raised, the container closure is somewhat expanded, whereby the space between the mouth-and-neck portion of the container body and the skirt wall of the container closure is reduced in atmospheric pressure. Owing to this pressure reduction, the washing liquid is sucked through the washing liquid passage. Furthermore, as the temperature of the washing liquid increases, the surface tension of the washing liquid decreases, thus making it easier for the washing liquid to pass through the washing liquid passage.

Thus, according to an aspect of the present invention, there is provided a method for washing a container, comprising:

charging a material to be contained into a container body having a mouth-and-neck portion;

then mounting a container closure on the mouth-and-neck portion of the container body, the container closure having a top panel wall, a cylindrical skirt wall extending downwardly from a peripheral edge of the top panel wall, and a washing liquid passage formed in at least one of an upper portion of the skirt wall and a peripheral edge portion of the top panel wall; and then jetting a washing liquid at the container closure so that the washing liquid passes through the washing liquid passage and enters a space between the mouth-and-neck portion of the container body and the skirt wall of the container closure, thereby washing an outer peripheral surface of the mouth-and-neck portion of the container body, and an inner peripheral surface of the skirt wall of the container closure, characterized in that the washing liquid is heated to 65° C. or higher when the washing liquid is jetted.

The material to be contained may be charged at ordinary temperature into the container body, and the container closure may be at ordinary temperature before the washing liquid is jetted.

According to another aspect of the invention, there is provided a method for washing a container, comprising:

charging a material to be contained into a container body having a mouth-and-neck portion;

then mounting a container closure on the mouth-and-neck portion of the container body, the container closure having a top panel wall, a cylindrical skirt wall extending downwardly from a peripheral edge of the top panel wall, and a washing liquid passage formed in at least one of an upper portion of the skirt wall and a peripheral edge portion of the top panel wall; and then jetting a washing liquid at the container closure so that the washing liquid passes through the washing liquid passage and enters a space between the mouth-and-neck portion of the container body and the skirt wall of the container closure, thereby washing an outer peripheral surface of the mouth-and-neck portion of the container body, and an inner peripheral surface of the skirt wall of the container closure, characterized in that the container closure is heated to 70° C. or higher, and then the washing liquid, heated to 45 to 70°C., is jetted.

The container closure can be heated by bringing a fluid heated to 70° C. or higher into contact with the container closure. If the material charged into the container body is a liquid heated to 70° C. or higher, the container closure can be heated by toppling the container sideways and keeping the material in contact with the container closure for 20 seconds or more. Alternatively, the container closure can be heated by jetting a heating fluid of 70° C. or higher at the container closure, and bringing the heating fluid into contact with the container closure. Preferably, the heating fluid is jetted for 2 minutes or more. The heating fluid may be heated tap water.

The washing liquid is preferably jetted for 10 minutes or more. The washing liquid may be heated tap water. The washing liquid passage is advantageously composed of cuts formed by applying a cutting blade onto an outer surface of the container closure to cut and perforate the container closure.

DETAILED DESCRIPTION OF THE PREFERRED EMBODIMENTS

Preferred embodiments of a method for washing a container in accordance with the present invention will now be described in detail with reference to the accompanying drawings.

Figure 1:
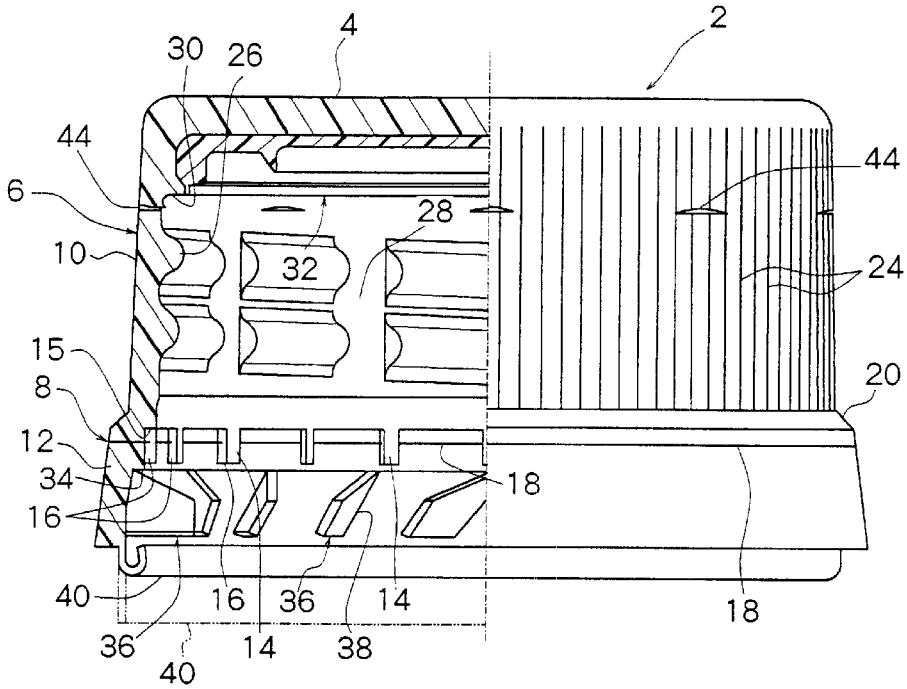
FIG. 1 is a partly sectional, partly side view of a container closure used in a preferred embodiment of a method for washing a container in accordance with the present invention.

FIG. 1 shows a container closure used in a preferred embodiment of the method for washing a container in accordance with the present invention. A container closure 2 can be advantageously formed by compression molding or injection molding a suitable plastic material, such as polypropylene or rigid polyethylene, into a desired shape, and applying processing (to be described later on) to the molded product. Such a container closure 2 has a circular top panel wall 4, and a nearly cylindrical skirt wall 6 extending downwardly from the peripheral edge of the top panel wall 4. The skirt wall 6 has a circumferential breakage line 8 formed therein. The skirt wall 6 is divided into a main portion 10 above the circumferential breakage line 8, and a tamper evident bottom portion 12 below the circumferential breakage line 8.

The circumferential breakage line 8 in the illustrated embodiment includes a plurality of bridging portions 14 disposed at circumferential intervals. In the region other than the plurality of bridging portions 14, the main portion 10 and the tamper evident bottom portion 12 of the skirt wall 6 are separated from each other by cutting. In other words, the tamper evident bottom portion 12 is connected to the main portion 10 of the skirt wall 6 via the plural bridging portions 14. In further detail, as will be understood from FIG. 1, a downwardly directed annular shoulder surface 15 slightly above the circumferential breakage line 8 is formed on the inner peripheral surface of the skirt wall 6. A plurality of protrusions 16 extending downwardly from the annular shoulder surface 15 are formed at circumferential intervals.

The circumferential breakage line 8 is formed by cutting the skirt wall 6 from its outer peripheral surface while leaving the whole or part of the protrusion 16 intact (in FIG. 1, this cutting is indicated by a solid line 18).

Near a lower end part of the outer peripheral surface of the main portion 10 of the skirt wall 6, a truncated conical portion 20 is formed which has an outer diameter progressively increasing in the downward direction. The lower end part of the main portion 10 of the skirt wall 6 (i.e., the part below the truncated conical portion 20), and the outer peripheral surface of the tamper evident bottom portion 12 continuing therefrom are also formed in a truncated conical shape whose outer diameter progressively increases, although slightly, in the downward direction. On the outer peripheral surface of the main portion 10 and above the truncated conical portion 20, knurls 24 are formed for preventing the slippage of fingers placed thereon. On the inner peripheral surface of the main portion 10, an internal thread 26 is formed. In the internal thread 26, axially extending notches 28 are formed at circumferentially spaced positions. On the inner peripheral surface of the main portion 10, an annular protrusion 30 is further formed in an upper end part of this inner peripheral surface. In a space defined by the annular protrusion 30 and the inner surface of the top panel wall 4, a sealing liner 32 is disposed which is formed separately from the body of the container closure 2. The sealing liner 32 can advantageously be formed by feeding a softened, molten plastic material onto the inner surface of the top panel wall 4, and compressing this plastic material by a pressing tool. Preferably, the plastic material for the sealing liner 32 is a relatively soft plastic material such as flexible polyethylene.

In an upper part of the inner peripheral surface of the tamper evident bottom portion 12 (slightly below the lower end of the protrusion 16), a downwardly directed annular shoulder surface 34 is formed. Below the annular shoulder surface 34, a plurality of circumferentially equally spaced flap pieces 36 are formed on the inner peripheral surface of the tamper evident bottom portion 12. Each of the flap pieces 36 protrudes radially inwardly in an inclined manner from a base edge 38 connected to the inner peripheral surface of the tamper evident bottom portion 12. The direction of inclination of each flap piece 36 is opposite to a closing turning direction of the container closure 2 at the time of mounting the container closure 2 on the mouth-and-neck portion of the container, i.e., a clockwise direction when viewed from above in FIG. 1. The base edge 38 of each of the flap pieces 36, itself, also extends downwardly in an inclined manner in a direction opposite to the above closing turning direction of the container closure 2. The lower end of the tamper evident bottom portion 12 is provided with a thin-walled curl 40 extending arcuately in a radially inward direction. The thin-walled curl 40 can be advantageously formed by forming its material into a substantially vertically downwardly extending shape, as shown by a two-dot chain line in FIG. 1, during compression molding or injection molding, and then applying a hot curling tool (not shown) of a suitable shape to the molded product to curl it into a shape as indicated by a solid line in FIG. 1.

Further referring to FIG. 1 for description of the illustrated container closure 2, a number of washing liquid passages 44 are formed in an upper part of the main portion 10 of the skirt wall 6, more specifically, between the annular protrusion 30 and the internal thread 26 formed in the axial direction on the inner peripheral surface of the main portion 10. In the illustrated embodiment, the washing liquid passages 44 include a plurality of (e.g., eight) cuts extending circumferentially at circumferentially spaced locations.

Such cuts are preferably formed by applying a cutting blade onto the outer surface of the main portion 10 of the skirt wall at a required site of the main portion 10 to cut and perforate the main portion 10. Details of the manner of forming the cuts by the cutting blade are given in Japanese Laid-Open Patent Publication No. 208693/1999. Relevant descriptions in this publication will be quoted in the present specification, and the details will be omitted herein. Instead of forming the cuts by the cutting blade, the cuts can be formed by other cutting means such as laser beams. Besides, instead of or in addition to the formation of cuts extending circumferentially in the upper part of the main portion 10 of the skirt wall 6, it is permissible to form cuts extending axially from a peripheral edge portion of the top panel wall 4 to the upper part of the main portion 10 of the skirt wall 6 as shown in FIGS. 13 and 14 of Japanese Laid-Open Patent Publication No. 208693/1999, or to form cuts extending arcuately in the peripheral edge portion of the top panel wall 4 as shown in FIGS. 15 and 16 of Japanese Laid-Open Patent Publication No. 208693/1999.

Figure 2:
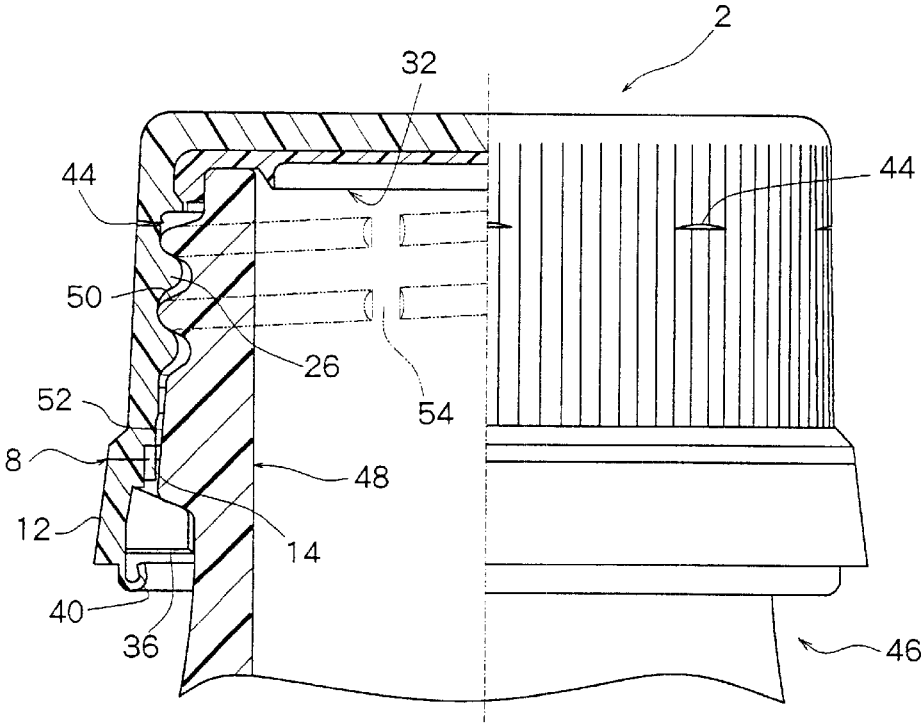
FIG. 2 is a partly sectional, partly side view showing the container closure used in the preferred embodiment of the method for washing a container in accordance with the present invention, and a mouth-and-neck portion of a container on which the container closure has been mounted.

FIG. 2 shows the container closure 2 mounted, as required, on the mouth-and-neck portion 48 of a container body 46. The mouth-and-neck portion 48 of the container body 46, which may be formed from a suitable plastic material such as polyethylene terephthalate or glass, is cylindrical as a whole. On its outer peripheral surface, an external thread 50 and an annular engaging jaw portion 52, positioned below the external thread 50, are formed. As shown by a two-dot chain line in FIG. 2, axially extending notches 54 are formed at circumferentially spaced positions in the external thread 50 as well, as in the case of the aforementioned internal thread 26 of the container closure 2. After a required material such as a juice beverage or a tea beverage is filled into the container body 46, the container closure 2 is mounted on the mouth-and-neck portion 48. At this time, the container closure 2 is fitted on the mouth-and-neck portion 48, and turned in the closing turning direction, i.e., clockwise when viewed from above in FIG. 2. As a result, the internal thread 26 in the container closure 2 is screwed around the external thread 50 of the mouth-and-neck portion 48, whereupon the container closure 2 is lowered in accordance with the turning and the threads. The flap pieces 36 formed in the tamper evident bottom portion 12 of the container closure 2 are elastically deformed and passed over the engaging jaw portion 52 of the mouth-and-neck portion 48. Then, the flap pieces 36 are elastically returned to the original form and engage with the engaging jaw portion 52. The sealing liner 32 disposed on the inner surface of the top panel wall 4 in the container closure 2 is brought into intimate contact with the top surface of the mouth-and-neck portion 48, whereby the mouth-and-neck portion 48 is sealed.

According to an aspect of the present invention, any of beverages such as various tea beverages, various juice beverages or various carbonated beverages, is filled at ordinary temperature into the container body 46, and then the container closure 2 is mounted on the mouth-and-neck portion 48 of the container body 46 to seal the mouth-and-neck portion 48. As is well known among people skilled in the art, some of the material tends to scatter and adhere to the outer peripheral surface of the mouth-and-neck portion 48 when the material is being filled into the container body 46. Thus, after the container closure 2 is mounted on the mouth-and-neck portion 48 to seal the mouth-and-neck portion 48, a washing step is performed.

Figure 3:
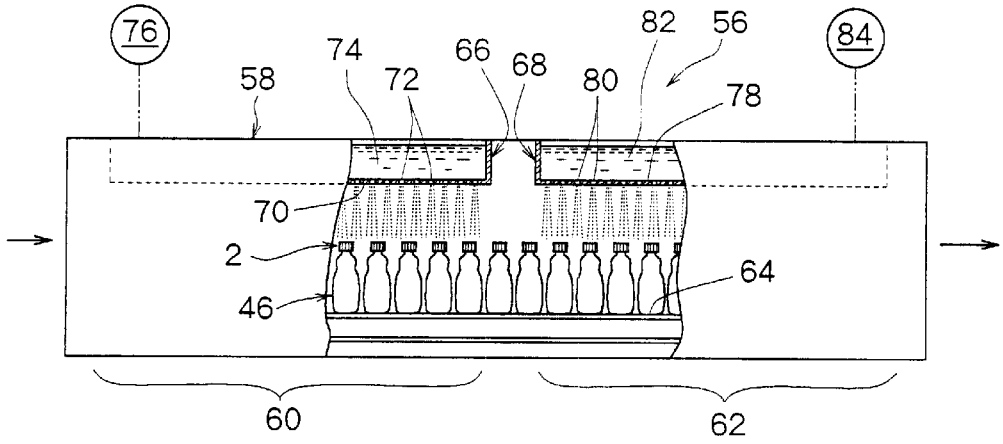
FIG. 3 is a schematic view, partially in cross-section, showing a washing/cooling device used in the preferred embodiment of the method for washing a container in accordance with the present invention.
Figure 4:
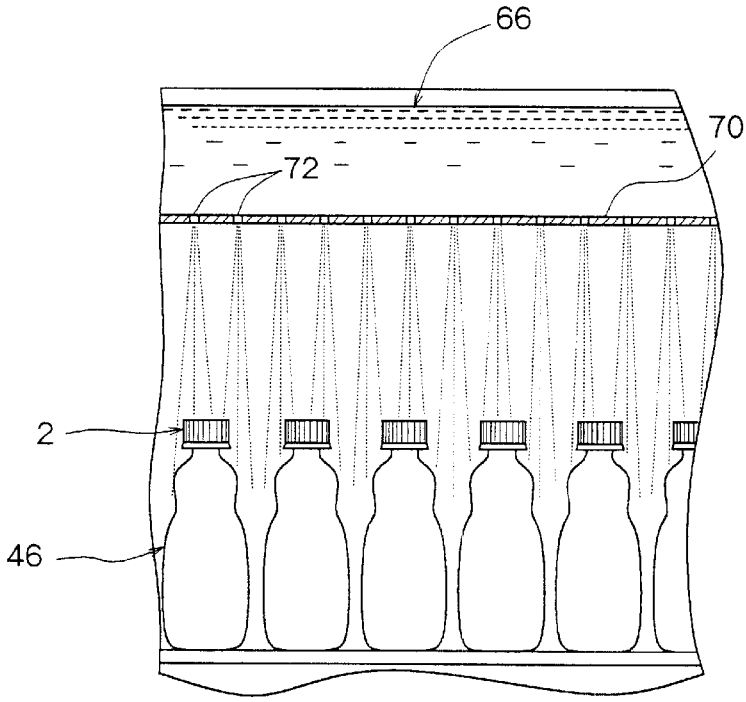
FIG. 4 is an enlarged, fragmentary, cross-sectional view showing the washing/cooling device of FIG. 3.

FIG. 3 is a partially sectional, schematic view showing a washing/cooling device for performing a washing step and a subsequent cooling step in an uninterrupted manner. FIG. 4 is an enlarged, fragmentary sectional view showing a part of the washing/cooling device. With reference to FIGS. 3 and 4 along with FIGS. 1 and 2 for further explanation, a washing/cooling device 56 includes a slenderly extending housing 58. An upstream portion of the housing 58 constitutes a washing housing 60, while a downstream portion of the housing 58 constitutes a cooling housing 62. A downstream end of the washing housing 60 is directly connected to an upstream end of the cooling housing 62. In a lower part of the housing 58, a carriage means 64 is disposed which extends substantially horizontally in an uninterrupted state through the washing housing 60 and the cooling housing 62. Such a carriage means 64 can be constituted of an ordinary belt conveyor. In an upper part of the washing housing 60, a washing liquid jet tank 66 is disposed. In an upper part of the cooling housing 62, a cooling liquid jet tank 68 is disposed. The washing liquid jet tank 66 has a bottom plate 70 which may be rectangular, and many jet holes 72 are formed in the bottom plate 70. Preferably, the diameter of each jet hole 72 is about 1.5 to 3.5 mm, and the pitch of the jet holes is about 15 to 25 mm. The washing liquid jet tank 66 is supplied with a washing liquid 74, which may be heated tap water, by a pump 76. Such a washing liquid is jetted downward through the jet holes 72 of the bottom plate 70. It is important that the temperature of the washing liquid be 65° C. or higher, preferably 68 to 70° C. The cooling liquid jet tank 68 has a bottom plate 78 which may be rectangular, and many jet holes 80 are formed in the bottom plate 78. The diameter and pitch of the jet holes 80 may be the same as those of the jet holes 72. The cooling liquid jet tank 68 is supplied with a cooling liquid 82, which may be tap water having a temperature of about 30° C., by means of a pump 84.

Such a cooling liquid 82 is jetted downward through the jet holes 80.

Containers, which have the material charged into the container body 46 and have the container closure 2 mounted on the mouth-and-neck portion 48 of the container body 46, are carried, one after another, to the upstream end of the carriage means 64 in the washing/cooling device 56 by a suitable carriage means (not shown) such as a belt conveyor, as shown schematically by the arrows in FIG. 3. At this time, a plurality of the containers are placed side by side. Then, the containers are carried at a required speed by the carriage means 64 through the washing housing 60 and the cooling housing 62. While the container is being carried through the washing housing 60, the washing liquid 74 jetted downward through the jet holes 72 of the washing liquid jet tank 66 is passed over the container closure 2 of the container. Such washing liquid 74, as will clearly be understood from Examples (to be give later), passes through the washing liquid passages 44 formed in the container closure 2, even when the washing liquid passages 44 are composed of sufficiently small cuts. Then, the washing liquid 74 enters the space between the outer peripheral surface of the mouth-and-neck portion 48 of the container body 46 and the inner peripheral surface of the skirt wall 6 of the container closure 2, and flows downward, washing the outer peripheral surface of the mouth-and-neck portion 48 and the inner peripheral surface of the skirt wall 6. The washing liquid 74 is guided to a drainage passageway (not shown) disposed in a lower end part of the housing 58, and drained out of the housing 58. The container passes below the washing liquid jet tank 66 in a period of time which is preferably 10 minutes or more, preferably about 13 to 17 minutes. In other words, it is preferred that the container closure 2 be supplied with a jet of the washing liquid 74 for 10 minutes or more, preferably 13 to 17 minutes. If the jetting time of the washing liquid is too short, a full washing effect will not be achieved. If the jetting time of the washing liquid is too long, by contrast, the contents of the container will be heated for a long time, and the taste may deteriorate, depending on the type of the contents.

While the container is being carried below the cooling liquid jet tank 68, the cooling liquid 82 is jetted at the container, whereby the container and its contents are cooled. Preferably, the container passes below the cooling liquid jet tank 68 in a period of time lasting about 15 minutes. The container discharged from the washing/cooling device 56 is transported, for example, to a packaging station, where it is packed in a box.

According to another aspect of the present invention, the material to be contained is charged into the container body 46 in a state in which the material is heated to 70° C. or higher, preferably 80 to 90° C. Then, the container closure 2 is mounted on the mouth-and-neck portion 48 of the container body 46 to seal the mouth-and-neck portion 48. Then, the container is toppled sideways, whereby the heated contents are brought into contact with the inner surface of the top panel wall 4 of the container closure 2, heating the container closure. After the container is returned again to an upright state, the container is carried into the washing/cooling device.

Figure 5:
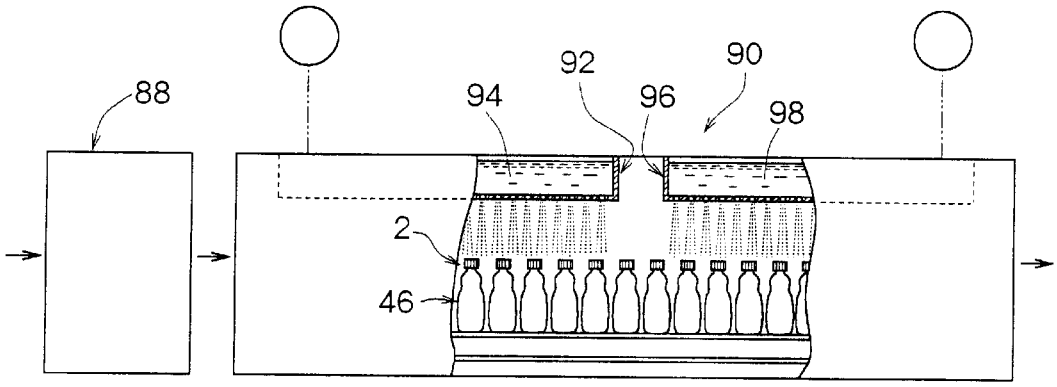
FIG. 5 is a schematic view showing a sideways toppling device and a washing/cooling device used in another preferred embodiment of the method for washing a container in accordance with the present invention.

With reference to FIG. 5 for further explanation, the container, in which the material heated to 70° C. or higher, preferably 80 to 90° C., has been charged into the container body 46 and the container closure 2 has been mounted on the mouth-and-neck portion 48, is carried into a sideways toppling device 88. In such a sideways toppling device 88, the container is toppled sideways to bring its contents into contact with the inner surface of the top panel wall 4 of the container closure 2, whereby the container closure 2 is heated to 70° C. or higher, preferably about 70 to 80° C. Then, the container is returned to an upright state. It is important that the time during which the container is kept in a sideways toppled state be 20 seconds or more, preferably about 30 seconds.

The container delivered out of the sideways toppling device 88 is carried into a washing/cooling device 90. The washing/cooling device 90 may be the same as the washing/cooling device 56 explained with reference to FIGS. 3 and 4, with the exception of the temperature of a washing liquid 94 supplied to a washing liquid jet tank 92. In the washing/cooling device 90 illustrated in FIG. 5, the washing liquid 94 is supplied to the washing liquid jet tank 92. The washing liquid 94 may have a temperature lower than the temperature of the washing liquid 74 in the washing/cooling device 56 illustrated in FIGS. 3 and 4, since the container closure 2 has already been heated in the sideways toppling device 88. The temperature of the washing liquid 94 supplied to the washing liquid jet tank 92 may be about 45 to 70° C. If the temperature of the washing liquid 94 is too high, the taste of the contents of the container may deteriorate. If the temperature of the washing liquid 94 is too low, on the other hand, a sufficient amount of the washing liquid cannot pass through the washing liquid passage 44, with the result that thorough washing is not achieved. As in the case of the washing/cooling device 56 illustrated in FIGS. 3 and 4, while the container is being carried below the washing liquid jet tank 92, the washing liquid 94 is passed over the container closure 2 of the container. Thus, the outer peripheral surface of the mouth-and-neck portion 48 and the inner peripheral surface of the skirt wall 6 are washed. Preferably, the container closure 2 is given a jet of the washing liquid 94 for 10 minutes or more, preferably 13 to 17 minutes. While the container is being carried below a cooling liquid jet tank 96, a cooling liquid 98 is jetted at the container, thereby the container and its contents are cooled. Advantageously, the container is supplied with a jet of the cooling liquid 98 for about 15 minutes.

According to still another aspect of the present invention, a material to be contained is charged, at ordinary temperature or as cooled to about 5° C., into the container body 46, and then the container closure 2 is mounted on the mouth-and-neck portion 48 of the container body 46 to seal the mouth-and-neck portion 48. Then, a heating step, a washing step, and a cooling step are performed in succession.

Figure 6:
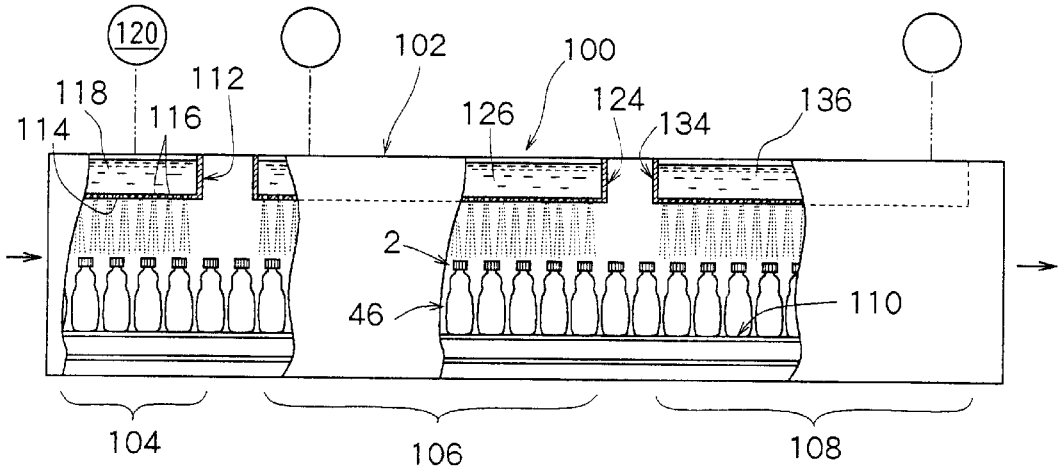
FIG. 6 is a schematic view showing a heating/washing/cooling device used in still another preferred embodiment of the method for washing a container in accordance with the present invention.

FIG. 6 is a schematic view showing a heating/washing/cooling device for performing a heating step, a washing step and a cooling step in an uninterrupted manner. The heating/washing/cooling device 100 includes a slenderly extending housing 102. An upstream portion of the housing 102 constitutes a heating housing 104, an intermediate portion of the housing 102 constitutes a washing housing 106, and a downstream portion of the housing 102 constitutes a cooling housing 108. The downstream end of the heating housing 104 is directly connected to the upstream end of the washing housing 106, and the downstream end of the washing housing 106 is directly connected to the upstream end of the cooling housing 108. In a lower part of the housing 102, a carriage means 110 is disposed which extends in an uninterrupted state through the heating housing 104, the washing housing 106 and the cooling housing 108. Such a carriage means 110 can be constituted of an ordinary belt conveyor. In an upper part of the heating housing 104, a heating liquid jet tank 112 is disposed. The heating liquid jet tank 112 has a bottom plate 114 which may be rectangular, and many jet holes 116 are formed in the bottom plate 114. The diameter and pitch of the jet holes 116 may be the same as those of the jet holes 72 formed in the bottom plate 70 of the washing liquid jet tank 66 explained with reference to FIGS. 3 and 4. The heating liquid jet tank 112 is supplied with a heating liquid 118, which may be heated tap water, by a pump 120. Such a heating liquid 118 is jetted downward through the jet holes 116. It is important that the temperature of the heating liquid 118 be 70° C. or higher, preferably 70 to 80C. If the temperature of the heating liquid 118 is too high, the taste of the contents of the container may deteriorate. If the temperature of the heating liquid 118 is too low, on the other hand, heating of the container closure 2 may become insufficient, and washing may fail. The washing housing 106 and the cooling housing 108 may be the same in constitution as the washing housing 60 and the cooling housing 62 explained with reference to FIGS. 3 and 4, with the exception of the temperature of a washing liquid 126 supplied to a washing liquid jet tank 124. The temperature of the washing liquid 126 supplied to the washing liquid jet tank 124 may be about 45 to 70° C.

Containers, in which a material to be contained has been charged into the container body 46 and the container closure 2 has been mounted on the mouth-and-neck portion 48 of the container body 46, are carried, one after another, to the upstream end of the carriage means 110 in the heating/washing/cooling device 100 by a suitable carriage means (not shown) such as a belt conveyor, as schematically shown by arrows in FIG. 6. During carriage, a plurality of the containers are placed side by side. Then, the containers are carried at a required speed by the carriage means 110 through the heating housing 104, the washing housing 106 and the cooling housing 108. While the container is being carried through the heating housing 104, the heating liquid 118, jetted downward through the jet holes 116 of the heating liquid jet tank 112, is passed over the container closure 2 of the container. As a result, the container closure 2 is heated to 70° C. or more, preferably 70 to 80C. The container passes below the heating liquid jet tank 112 in a period of time which is preferably 2 to 4 minutes. In other words, it is preferred that the container closure 2 be supplied with a jet of the heating liquid 118 for 2 to 4 minutes. If the jetting time of the heating liquid 118 is too long, the taste of the contents of the container may deteriorate. If the jetting time of the heating liquid 118 is too short, on the other hand, heating of the container closure 2 will become insufficient, and washing will fail. The heating liquid 118 is guided to a drainage passageway (not shown) disposed in a lower end part of the housing 102, and drained out of the housing 102. While the container is carried through the washing housing 106, the washing liquid 126 is jetted at the container closure 2 of the container, whereby the outer peripheral surface of the mouth-and-neck portion 48 and the inner peripheral surface of the skirt wall 6 are washed. The container passes below the washing liquid jet tank 124 in a period of time which is preferably 10 minutes or more, preferably about 13 to 17 minutes. While the container is being carried below a cooling liquid jet tank 134, a cooling liquid 136 is jetted at the container, whereby the container and its contents are cooled. Preferably, the container passes below the cooling liquid jet tank 134 in a period of time lasting about 15 minutes. The container discharged from the heating/washing/cooling device 100 is transported, for example, to a packaging station, where it is packed in a box.

Referring to FIG. 2 again, in unsealing the mouth-and-neck portion 48 of the container body 46, the container closure 2 is turned in an opening turning direction, i.e., counterclockwise when viewed from above in FIG. 2. By so doing, the internal thread 26 formed in the main portion 10 of the skirt wall 6 in the container closure 2 is moved along the external thread 50 formed in the mouth-and-neck portion 48 of the container body 46, so that the container closure 2 is raised in accordance with the turning and the threads. In the tamper evident bottom portion 12 of the container closure 2, however, the flap pieces 36 formed on its inner peripheral surface are engaged with, and stopped at, the engaging jaw portion 52 of the mouth-and-neck portion 48, whereby the tamper evident bottom portion 12 is inhibited from moving upward. Thus, a considerable stress is generated in the bridging portions 14 in the circumferential breakage line 8 formed in the skirt wall 6, whereby the bridging portions 14 are broken. Consequently, the tamper evident bottom portion 12 of the skirt wall 6 is separated from the main portion 10. Once this state is achieved, the tamper evident bottom portion 12 is retained on the mouth-and-neck portion 48. Whereas the other portions of the container closure 2 are raised in accordance with the turning and the threads, and released from the mouth-and-neck portion 48 to unseal the mouth-and-neck portion 48.

EXAMPLE 1

A container closure of a shape as illustrated in FIG. 1 was formed. The body of the container closure was molded from polypropylene, and the sealing liner was molded from flexible polyethylene. Eight cuts constituting the washing liquid passages were formed with the use of a cutting blade as shown in FIGS. 9 to 11 of Japanese Laid-Open Patent Publication No. 208693/1999. The total height of the container closure was 20.1 mm, and the outer diameter of the skirt wall at a position 4.8 mm from the upper surface of the top panel wall was 29.9 mm. The thickness of a main portion of the cutting blade (a portion other than a tip portion whose thickness progressively decreases) was 0.3 mm, and the circumferential length of each of the cuts formed was 2.0 mm.

The body of a commercially available polyethylene terephthalate container, generally called "a 500 mm PET bottle", was charged with tap water at ordinary (e.g., ambient) temperature. Then, the above-mentioned container closure was dipped in a commercially available juice beverage, so that juice adhered to the entire container closure. Then, the container closure was manually mounted on the mouth-and-neck portion of the container body. Afterwards, a device for a washing experiment was used to conduct the following experiment: The washing experiment device has a horizontal support stand measuring 550 X 590 mm. Above the support stand, a jet tank is disposed. A bottom plate of the jet tank extends horizontally, and 24 X 27 jet holes with a diameter of 2.5 mm and a pitch of 20.0 mm have been punched in the bottom plate. Ten of the containers were placed on the support stand, and tap water at a temperature of 65° C. was supplied to the jet tank for 15 minutes at a rate of 95 liters/min so as to be jetted downward through the jet holes of the jet tank and passed over the container closures. The vertical distance between the upper surface of the container closure of each of the containers placed on the support stand and the bottom plate of the jet tank was 50 cm. After jetting of the washing liquid, the container closures were released from the container bodies, and checked for adhesion of juice to the outer peripheral surface of the mouth-and-neck portion of the container body. The results are shown in Table 1.

EXAMPLE 2

A washing experiment was conducted under the same conditions as in Example 1, except that the temperature of the tap water supplied to the jet tank was 70° C. The results are shown in Table 1.

COMPARATIVE EXAMPLE 1

A washing experiment was conducted under the same conditions as in Example 1, except that the temperature of the tap water supplied to the jet tank was 30° C. The results are shown in Table 1.

COMPARATIVE EXAMPLE 2

A washing experiment was conducted under the same conditions as in Example 1, except that the temperature of the tap water supplied to the jet tank was 50° C. The results are shown in Table 1.

COMPARATIVE EXAMPLE 3

A washing experiment was conducted under the same conditions as in Example 1, except that the temperature of the tap water supplied to the jet tank was 60° C. The results are shown in Table 1.

TABLE 1

| | Temp. of washing liquid | Number of container bodies evaluated ◎ | Number of container bodies evaluated ○ | Number of container bodies evaluated Δ | Number of container bodies evaluated X |
|---|---|---|---|---|---|
| Comp. Ex. 1 | 30° C. | | | | 10 |
| Comp. Ex. 2 | 50° C. | | | 2 | 8 |
| Comp. Ex. 3 | 60° C. | | 5 | 5 | |
| Ex. 1 | 65° C. | 7 | 3 | | |
| Ex. 2 | 70° C. | 9 | 1 | | |

◎: No juice was left on the outer peripheral surface of the mouth-and-neck portion.
○: A trace amount of juice was left on a part of the outer peripheral surface of the mouth-and-neck portion.
Δ: Juice was left on a part of the outer peripheral surface of the mouth-and-neck portion.
X: Juice was left on nearly the entire outer peripheral surface of the mouth-and-neck portion.

EXAMPLE 3

A washing experiment was conducted under the same conditions as in Example 1, except that the body of the container was charged with tap water of 85° C., the container closure was mounted on the container body, and then the container was toppled sideways for only 30 seconds, and except that the temperature of the washing liquid was 45° C. The results are shown in Table 2.

EXAMPLE 4

A washing experiment was conducted under the same conditions as in Example 3, except that the temperature of the washing liquid was 50° C. The results are shown in Table 2.

EXAMPLE 5

A washing experiment was conducted under the same conditions as in Example 3, except that the temperature of the washing liquid was 60° C. The results are shown in Table 2.

COMPARATIVE EXAMPLE 4

A washing experiment was conducted under the same conditions as in Example 3, except that the temperature of the washing liquid was 20° C. The results are shown in Table 2.

COMPARATIVE EXAMPLE 5

A washing experiment was conducted under the same conditions as in Example 3, except that the temperature of the washing liquid was 30° C. The results are shown in Table 2.

COMPARATIVE EXAMPLE 6

A washing experiment was conducted under the same conditions as in Example 3, except that the temperature of the washing liquid was 40° C. The results are shown in Table 2.

TABLE 2

| | Temp. of washing liquid | Number of container bodies evaluated ◎ | Number of container bodies evaluated ○ | Number of container bodies evaluated Δ | Number of container bodies evaluated X |
|---|---|---|---|---|---|
| Comp. Ex. 4 | 20° C. | | | | 10 |
| Comp. Ex. 5 | 30° C. | | | 1 | 9 |
| Comp. Ex. 6 | 40° C. | | 8 | 2 | |
| Ex. 3 | 45° C. | 7 | 3 | | |
| Ex. 4 | 50° C. | 8 | 2 | | |
| Ex. 5 | 60° C. | 10 | | | |

EXAMPLE 6

A washing experiment was conducted under the same conditions as in Example 1, except that tap water of 73° C. was initially supplied to the jet tank for 3 minutes at a rate of 95 liters/min, and after a 5-second interruption of water supply, tap water of 50° C. was supplied to the jet tank for 15 minutes at a rate of 95 liters/min. The results are shown in Table 3.

EXAMPLE 7

A washing experiment was conducted under the same conditions as in Example 6, except that the temperature of the tap water supplied to the jet tank after the 5-second interruption of water supply was 60° C. The results are shown in Table 3.

COMPARATIVE EXAMPLE 7

A washing experiment was conducted under the same conditions as in Example 6, except that the temperature of the tap water supplied to the jet tank after the 5-second interruption of water supply was 30° C. The results are shown in Table 3.

COMPARATIVE EXAMPLE 8

A washing experiment was conducted under the same conditions as in Example 6, except that the temperature of the tap water supplied to the jet tank after the 5-second interruption of water supply was 40° C. The results are shown in Table 3.

TABLE 3

| | Temp. of washing liquid | Number of container bodies evaluated ◎ | Number of container bodies evaluated ○ | Number of container bodies evaluated Δ | Number of container bodies evaluated X |
|---|---|---|---|---|---|
| Comp. Ex. 7 | 30° C. | | 4 | 6 | |
| Comp. Ex. 8 | 40° C. | | 7 | 3 | |
| Ex. 6 | 50° C. | 7 | 3 | | |
| Ex. 7 | 60° C. | 10 | | | |

What is claimed is:

1. A method of washing a container, comprising:

charging a material to be contained into a container body having a mouth-and-neck portion;

mounting a container closure on the mouth-and-neck portion of the container body, the container closure having a top panel wall, a cylindrical skirt wall extending downwardly from a peripheral edge of the top panel wall, and a washing liquid passage formed in at least one of an upper portion of the skirt wall and a peripheral edge portion of the top panel wall; and jetting a washing liquid at the container closure for 10 minutes or more so that the washing liquid passes through the washing liquid passage and enters a space between the mouth-and-neck portion of the container body and the skirt wall of the container closure to wash an outer peripheral surface of the mouth-and-neck portion of the container body and an inner peripheral surface of the skirt wall of the container closure, wherein the washing liquid is heated to a temperature in the range of from 65° C. to 70° C. when the washing liquid is jetted.

2. The method of washing a container as claimed in claim 1, wherein the material to be contained is charged at ambient temperature into the container body, and the container closure is at ambient temperature before the washing liquid is jetted.

3. The method of washing a container as claimed in claim 1, wherein the washing liquid is heated tap water.

4. The method of washing a container as claimed in claim 1, wherein the washing liquid is heated to a temperature of 65° C. when the washing liquid is jetted.

5. The method of washing a container as claimed in claim 1, wherein the washing liquid is jetted for a time in the range of from 13 minutes to 17 minutes.

6. The method of washing a container as claimed in claim 5, wherein the washing liquid is jetted for 15 minutes.

7. A method of washing a container, said method comprising:

charging a liquid to be contained into a container body having a mouth-and- neck portion;

heating the liquid to a temperature of 70° C. or higher;

mounting a container closure on the mouth-and-neck portion of the container body, the container closure having a top panel wall, a cylindrical skirt wall extending downwardly from a peripheral edge of the top panel wall, and washing liquid passages formed in at least one of an upper portion of the skirt wall and a peripheral edge portion of the top panel wall;

toppling the container for 20 seconds or more to maintain the heated liquid in contact with the container closure so as to heat the container closure; and jetting at the container closure a washing liquid heated to 45° to 70° C. so that the washing liquid passes through the washing liquid passages and enters a space between the mouth-and-neck portion of the container body and the skirt wall of the container closure to wash an outer peripheral surface of the mouth-and-neck portion of the container body and an inner peripheral surface of the skirt wall of the container closure.

8. The method of washing a container as claimed in claim 7, wherein the washing liquid is jetted for 10 minutes or more.

9. The method of washing a container as claimed in claim 8, wherein the washing liquid is jetted for 15 minutes.

10. The method of washing a container as claimed in claim 9, wherein the container is toppled for 30 seconds.

11. The method of washing a container as claimed in claim 10, wherein the washing liquid is heated to a temperature in the range of from 45° to 60° when the washing liquid is jetted.

12. The method of washing a container as claimed in claim 7, wherein the washing liquid is heated to a temperature in the range of from 45° to 60° when the washing liquid is jetted.

13. The method of washing a container as claimed in claim 7, wherein the container is toppled for 30 seconds.

14. The method of washing a container as claimed in claim 7, wherein the washing liquid is heated tap water.

15. A method of washing a container, said method comprising:

charging a liquid to be contained into a container body having a mouth-and-neck portion;

mounting a container closure on the mouth-and-neck portion of the container body, the container closure having a top panel wall, a cylindrical skirt wall extending downwardly from a peripheral edge of the top panel wall, and washing liquid passages formed in at least one of an upper portion of the skirt wall and a peripheral edge portion of the top panel wall;

jetting a fluid heated to a first temperature of 70° C. or higher at the container closure for 2 to 4 minutes to heat the container closure; and then jetting at the container closure a washing liquid heated to a second temperature of 450 to 70° C. so that the washing liquid passes through the washing liquid passages and enters a space between the mouth-and-neck portion of the container body and the skirt wall of the container closure to wash an outer peripheral surface of the mouth-and-neck portion of the container body and an inner peripheral surface of the skirt wall of the container closure.

16. The method of washing a container as claimed in claim 15, wherein the liquid is jetted for 10 minutes or more.

17. The method of washing a container as claimed in claim 16, wherein the liquid is jetted for 15 minutes.

18. The method of washing a container as claimed in claim 15, wherein the first temperature is 73° C.

19. The method of washing a container as claimed in claim 15, wherein an interval of 5 seconds passes between stopping jetting of the fluid and starting jetting of the liquid.

20. The method of washing a container as claimed in claim 15, wherein the washing liquid is heated to a temperature of 65° C. when the washing liquid is jetted.

21. The method of washing a container as claimed in claim 15, wherein the washing liquid is heated tap water.

* * * * *